US008408925B2

(12) United States Patent
Borgstrom et al.

(10) Patent No.: US 8,408,925 B2
(45) Date of Patent: Apr. 2, 2013

(54) VISIBLE OPEN FOR SWITCHGEAR ASSEMBLY

(75) Inventors: Alan D. Borgstrom, Hackettstown, NJ (US); Kieran P. Higgins, Great Meadows, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/018,899

(22) Filed: Feb. 1, 2011

(65) Prior Publication Data

US 2011/0189887 A1 Aug. 4, 2011

Related U.S. Application Data

(60) Provisional application No. 61/300,852, filed on Feb. 3, 2010.

(51) Int. Cl.
*H01R 13/53* (2006.01)

(52) U.S. Cl. ..... 439/181; 439/921

(58) Field of Classification Search ..... 439/181, 439/507, 921
See application file for complete search history.

(56) References Cited

U.S. PATENT DOCUMENTS

| | | | | |
|---|---|---|---|---|
| 2,870,298 | A | 1/1959 | Schwager | |
| 3,399,286 | A | 8/1968 | Kerr | |
| 3,471,669 | A | 10/1969 | Curtis | |
| 3,740,700 | A * | 6/1973 | Robertson | 439/507 |
| 3,812,314 | A | 5/1974 | Nonken | |
| 3,932,717 | A | 1/1976 | Dike et al. | |
| 3,955,167 | A | 5/1976 | Kumbera | |
| 3,956,721 | A | 5/1976 | Link | |
| 3,980,374 | A * | 9/1976 | Fallot | 439/89 |
| 4,124,790 | A | 11/1978 | Kumbera et al. | |
| 4,150,270 | A | 4/1979 | Zunick | |
| 4,202,591 | A | 5/1980 | Borgstrom | |
| 4,220,942 | A | 9/1980 | Meister et al. | |
| 4,249,050 | A | 2/1981 | Okumura | |
| 4,256,938 | A | 3/1981 | Efinger et al. | |
| 4,316,646 | A | 2/1982 | Siebens | |

(Continued)

FOREIGN PATENT DOCUMENTS

WO 03096504 A1 11/2003

OTHER PUBLICATIONS

"Oil and Vacuum-Break Switches" Cooper Power Systems, Electrical Apparatus 260-20, Feb. 2002.

*Primary Examiner* — Hien Vu
(74) *Attorney, Agent, or Firm* — Snyder, Clark, Lesch & Chung, LLP

(57) ABSTRACT

An electrical connector assembly may include a connector body having a conductor receiving end, a first connector end, and a visible open port. A contact assembly may extend axially within the connector body from the conductor receiving end to the first connector end. A conductive insert may be inserted into the visible open port. At least a portion of the contact assembly is visible through the visible open port prior to insertion of the conductive insert or following removal of the conductive insert. The portion of the contact assembly visible through the visible open port includes a first contact portion and a second contact portion separated by a gap. A portion of the conductive insert is received in the gap between the first contact portion and the second contact portion to allow current to flow from the second contact portion to the first contact portion upon insertion of the conductive insert into the visible open port.

16 Claims, 8 Drawing Sheets

U.S. PATENT DOCUMENTS 4,323,874 A 4/1982 Link
4,484,046 A 11/1984 Neuhouser
4,568,804 A 2/1986 Luehring
4,596,906 A 6/1986 Chabala et al.
4,600,260 A 7/1986 Stepniak et al.
4,645,888 A 2/1987 Barkan et al.
4,799,895 A 1/1989 Borgstrom
4,865,559 A 9/1989 Clabburn
4,888,455 A 12/1989 Hanson
4,891,016 A 1/1990 Luzzi et al.
4,910,367 A 3/1990 Akers et al.
4,955,823 A 9/1990 Luzzi
5,089,931 A 2/1992 Thuries et al.
5,387,772 A 2/1995 Bestel
5,578,805 A 11/1996 Berger et al.
5,641,306 A 6/1997 Stepniak
5,667,060 A 9/1997 Luzzi
5,721,412 A 2/1998 Schifko et al.
5,790,041 A 8/1998 Lee
5,795,180 A 8/1998 Siebens
5,808,258 A 9/1998 Luzzi
5,864,942 A 2/1999 Luzzi
5,912,604 A 6/1999 Harvey et al.
5,917,167 A 6/1999 Bestel
5,957,712 A 9/1999 Stepniak
6,130,394 A 10/2000 Högl
6,168,447 B1 1/2001 Stepniak et al.
6,213,799 B1 4/2001 Jazowski et al.
6,319,051 B1 11/2001 Chang et al.
6,364,216 B1 * 4/2002 Martin ..... 439/181
6,482,049 B1 11/2002 Swearingen
6,491,548 B2 12/2002 Stepniak et al.
6,504,103 B1 1/2003 Meyer et al.
6,561,841 B2 5/2003 Norwood et al.
6,585,531 B1 7/2003 Stepniak et al.
6,761,577 B1 7/2004 Koehler
6,825,426 B2 11/2004 Muench et al.
6,843,685 B1 1/2005 Borgstrom et al.
6,864,456 B1 3/2005 Banghard et al.
6,883,804 B2 4/2005 Cobb
6,939,151 B2 9/2005 Borgstrom et al.
6,984,791 B1 1/2006 Meyer et al.
7,144,279 B2 12/2006 Zahnen et al.
7,182,647 B2 2/2007 Muench et al.
7,262,362 B2 8/2007 Holaus et al.
7,397,012 B2 7/2008 Stepniak et al.
7,497,723 B2 3/2009 Brassell et al.
7,501,598 B2 3/2009 Stepniak et al.
7,503,785 B2 3/2009 Stepniak
7,520,773 B2 4/2009 Siebens et al.
7,579,571 B2 8/2009 Siebens et al.
7,579,572 B2 8/2009 Stepniak et al.
7,648,376 B1 1/2010 Borgstrom
7,695,291 B2 4/2010 Hughes et al.
7,754,992 B2 7/2010 Stepniak et al.
7,883,361 B2 * 2/2011 Ambo et al. ..... 439/507
7,891,999 B2 2/2011 Hughes et al.
7,901,228 B2 * 3/2011 Hughes et al. ..... 439/181
8,128,423 B2 3/2012 Borgstrom et al.
2008/0311779 A1 12/2008 Brassell et al.
2009/0149064 A1 6/2009 Schuster et al.
2010/0022111 A1 1/2010 Borgstrom
2011/0189887 A1 8/2011 Borgstrom et al.

* cited by examiner

VISIBLE OPEN FOR SWITCHGEAR ASSEMBLY

CROSS-REFERENCE TO RELATED APPLICATION

This application claims priority under 35. U.S.C. §119, based on U.S. Provisional Patent Application No. 61/300,852 filed Feb. 3, 2010, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to an electrical cable connector, such as a power cable elbow or T-connector connected to electrical switchgear assembly.

High and medium voltage switch assemblies may include sub-atmospheric or vacuum type circuit interrupters, switches, or circuit breakers for use in electric power circuits and systems. Insulated vacuum bottles switches in such systems typically do not provide means for visual inspection of the contacts to confirm whether they are open (visible break) or closed. Non-vacuum bottle type switches previously used were designed to include contacts in a large gas or oil filled cabinet that allowed a glass window to be installed for viewing the contacts. However, with vacuum type switches, there is typically provided no means of directly viewing contacts in the vacuum bottles since the bottles are made of metal and ceramic nontransparent materials.

Typically, conventional insulated switches using vacuum technology are sealed inside the vacuum bottle and hidden from view. The voltage source and the load are connected to the switch, but the switch contacts are not visible. The only means for determining the status of the switch contacts is the position of a switch handle associated with the switch. If the linkage between the handle and the switch contacts is inoperative or defective, there is no positive indication that allows the operating personnel to accurately determine the position of the contacts. This can result in false readings, which can be very dangerous to anyone operating the switch or working on the lines.

DETAILED DESCRIPTION OF THE PREFERRED EMBODIMENTS

The following detailed description refers to the accompanying drawings. The same reference numbers in different drawings may identify the same or similar elements.

Figure 1:
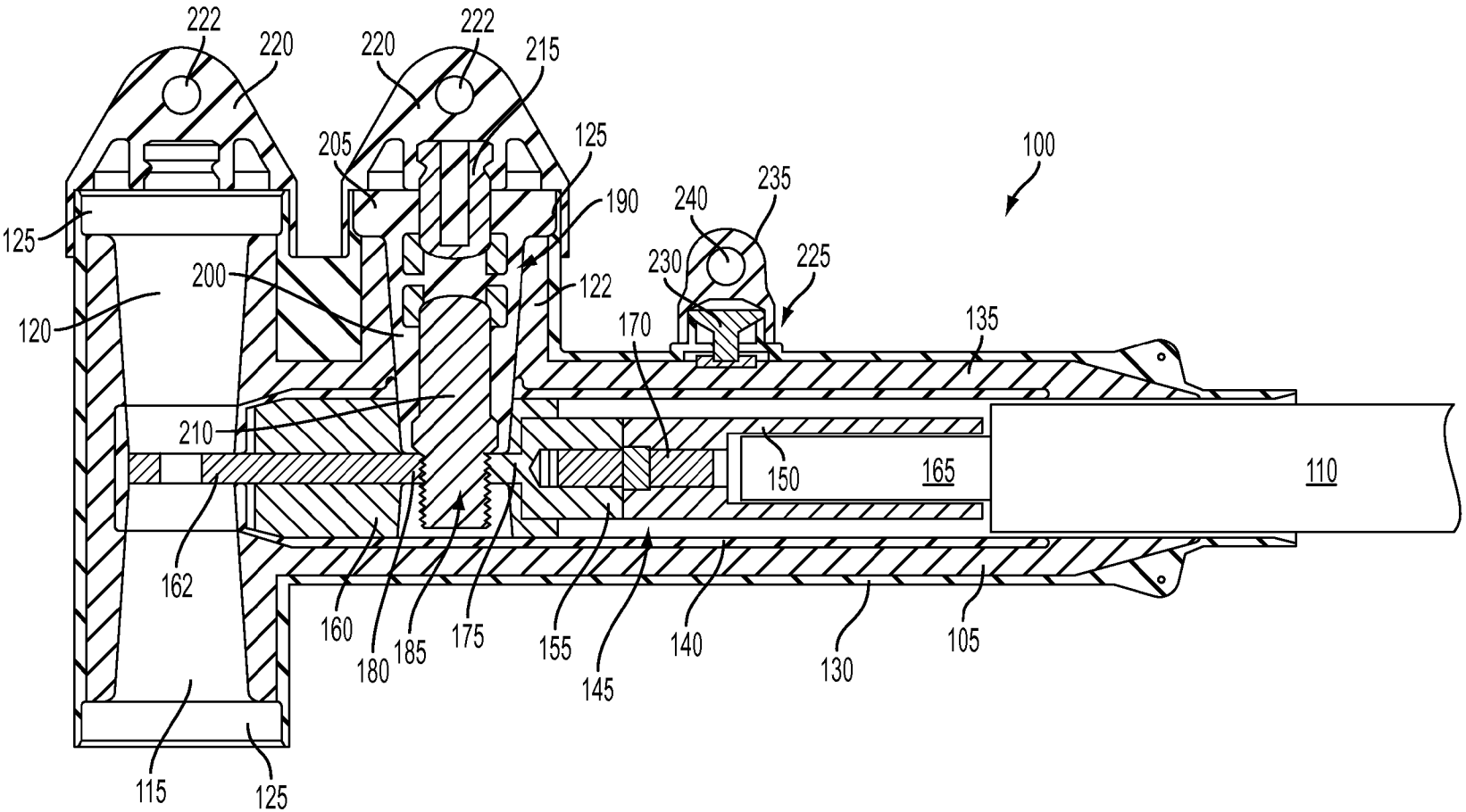
FIG. 1 is a schematic cross-sectional diagram illustrating an electrical connector consistent with implementations described herein.
Figure 2A:
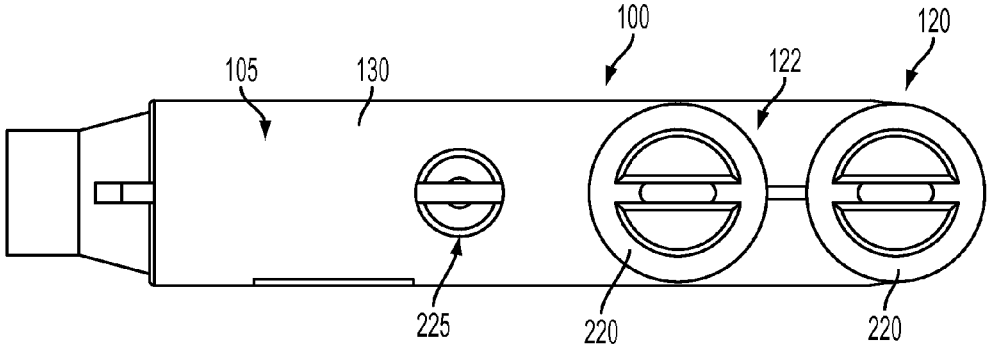
FIG. 2A is top view of the electrical connector of FIG. 1.
Figure 2B:
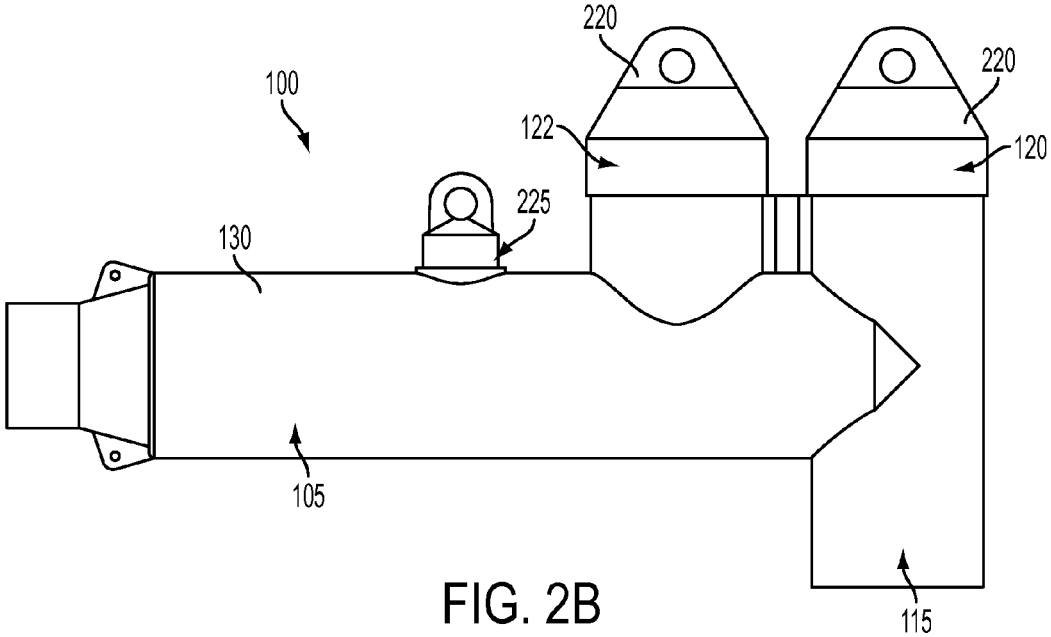
FIG. 2B is a side view of the electrical connector of FIG. 1.
Figure 3:
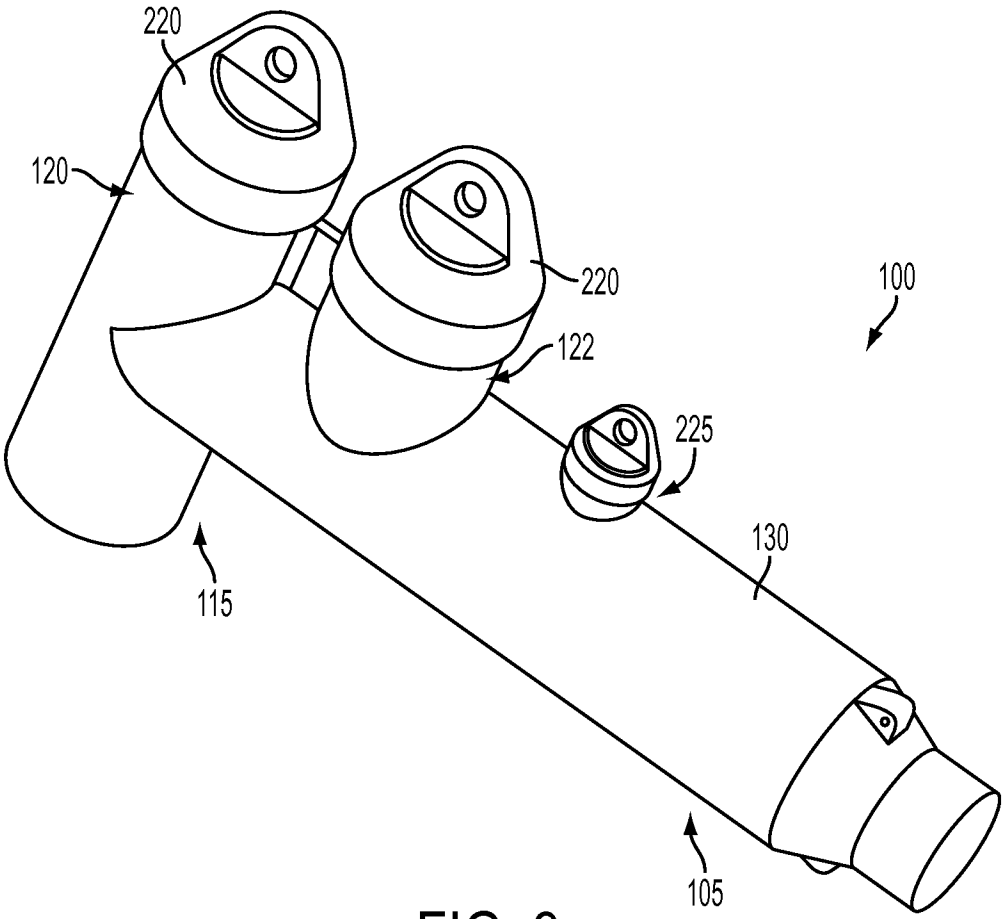
FIG. 3 is an isometric view of the electrical connector of FIG. 1.

FIG. 1 is a schematic cross-sectional diagram illustrating a power cable elbow connector 100 configured in a manner consistent with implementations described herein. FIGS. 2A, 2B, and 3 illustrate top, side, and isometric views, respectively, of connector 100. As shown in FIG. 1, power cable elbow connector 100 may include a conductor receiving end 105 for receiving a power cable 110 therein, first and second T ends 115/120 that include openings for receiving a deadbreak transformer bushing or other high or medium voltage terminal, such as an insulating plug, or other power equipment, and a visible open port 122. Each of first T end 115, second T end 120, and visible open port 122 may include a flange or elbow cuff 125 surrounding the open receiving end thereof. Conductor receiving end 105 may extend substantially axially and may include a bore extending therethrough. First and second T ends 115/120 and visible open port 122 may project substantially perpendicularly from conductor receiving end 105, as illustrated in FIGS. 2B and 3.

Power cable elbow connector 100 may include an electrically conductive outer shield 130 formed from, for example, a conductive peroxide-cured synthetic rubber, commonly referred to as EPDM (ethylene-propylene-dienemonomer). Within shield 130, power cable elbow connector 100 may include an insulative inner housing 135, typically molded from an insulative rubber or epoxy material. Within insulative inner housing 135, power cable elbow connector 100 may include a conductive or semi-conductive insert 140 that surrounds the connection portion of power cable 110.

Conductor receiving end 105 of power cable elbow connector 100 may be configured to receive power cable 110 therein. As described below with respect to FIGS. 4A-4E, a forward end of power cable 110 may be prepared by connecting power cable 110 to a conductor spade assembly 145. As illustrated in FIG. 1, conductor spade assembly 145 may include a modular configuration. More specifically, conductor spade assembly 145 may include a crimp connector portion 150, a rearward conductor portion 155, a body portion 160, and a spade portion 162.

Crimp connector portion 150 may include a substantially cylindrical assembly configured to receive a center conductor 165 of power cable 110 therein. Crimp connector portion 150 may be securely fastened to rearward conductor portion 155, such as via a threaded stud 170 threaded into each of crimp connector portion 150 and rearward conductor portion 155. Upon insertion of cable 110, crimp connector portion 150 may be crimped onto power cable 110 prior to insertion into conductor receiving end 105.

Exemplary embodiments of body portion 160 are described in detail below with respect to FIGS. 4A-4E and may be configured to maintain a forward end 175 of rearward conductor portion 155 and a rearward end 180 of spade portion 162 in a spaced relationship relative to each other for providing an open break 185 in the conductor. Consistent with implementations described herein, open break 185 may be visible by a user or installer by looking into visible open port 122. Visually identifying an open break in the conductor enables the installer to ensure that the connector is de-energized prior to interacting with connector 100. In one exemplary implementation, body portion 160 may be formed of an insulative material such as EPDM, or any suitably insulative material. Rearward conductor portion 155 and spade portion 162 may be formed of a suitably conductive material, such as copper, or aluminum, or a conductive alloy.

As shown in FIGS. 1 and 2B, first T end 115 and/or second T end 120 may each include a substantially cylindrical configuration having a bore therein for receiving a deadbreak bushing, insulating plug, or other electrical device (not shown) having a probe or contact extending into connector 100. The probe may be connected to power cable 110 via a cable connector engaged with conductor spade assembly 145. In some implementations, the probe may be coupled to conductor spade assembly 145 via a threaded engagement, e.g., via a threaded stud adapted for coupling to the insert and spade portion 162 of conductor spade assembly 145.

Consistent with implementations described herein, visible open port 122 may be configured as a substantially cylindrical extension projecting from conductor receiving end 105 to form an aperture or bore 190 in conductive outer shield 130 through which break 185 in conductor spade assembly 145 may be viewed. As with first T end 115 and second T end 120, bore 190 may be configured to receive a plug or other electrical device therein for use when power cable elbow connector 100 is energized.

As illustrated in FIG. 1, in one exemplary implementation, bore 190 may be configured to receive a visible open conductor plug 200 therein. Visible open conductor plug 200 may include an insulating body portion 205, a conductive core portion 610 secured within a lower portion of insulating body portion 205, and an assembly facilitating element 215 secured within an upper portion of insulating body portion 205. Prior to re-energizing power cable elbow connector 100, visible open conductor plug 200 may be inserted into bore 190. In one exemplary implementation, visible open conductor plug 200 may be secured to connector 100 via a threaded engagement, e.g., between exterior threads on conductive core portion 210 and corresponding threads on facing surfaces of rearward conductor portion 155 and spade portion 162. For example, visible open conductor plug 200 may be rotated by a suitable tool applied to assembly facilitating element 215. In one embodiment, bore 190 of connector 100 may include a substantially conical configuration, tapering from a first diameter at an outer end of bore 190, to a second diameter smaller than the first diameter at an inner end of bore 190. An outer surface of body portion 205 may include a corresponding conical configuration and may be formed of an insulating material, such as insulative rubber or epoxy.

Consistent with implementations described herein, conductive core portion 210 may be formed of a conductive material, such as copper or aluminum, and may be configured to electrically connect rearward conductor portion 155 and spade portion 162 upon insertion of insulating plug 200 into bore 190. More specifically, conductive core portion 210 may be received in break 185, such that an external surface of conductive core portion 210 contacts opposing surfaces of rearward conductor portion 155 and spade portion 162. In this manner, break 185 may be "closed" upon insertion of insulating plug 200 into bore 190. Additional details and exemplary embodiments of insulating plug 200 and conductor spade assembly 145 are set forth below in FIGS. 4A-4E and 5A-5B.

As shown in FIG. 1, first T end 115 and visible open port 122 may be configured to receive or otherwise couple with a caps 220. Each of caps 220 may be configured to sealingly engage a portion of outer shield 130 about T end 115 or visible open port 122 to protect the terminal from environmental conditions. In some implementations, cap 220 may be further configured to securely engage a feature associated with an electrical device seated within first T end 115, such as assembly facilitating element 215 on visible open conductor plug 200. Caps 220 may each include an aperture 222 for facilitating removal of caps 220, e.g., using a hooked lineman's tool. Alternatively, caps 220 may be removed by hand.

In one exemplary implementation, power cable elbow connector 100 may include a voltage detection test point assembly 225 for sensing a voltage in connector 100. Voltage detection test point assembly 225 may be configured to allow an external voltage detection device, to detect and/or measure a voltage associated with connector 100.

For example, as illustrated in FIG. 1, voltage detection test point assembly 225 may include a test point terminal 230 embedded in a portion of insulative inner housing 135 and extending through an opening within outer shield 130. In one exemplary embodiment, test point terminal 230 may be formed of a conductive metal or other conductive material. In this manner, test point terminal 230 may be capacitively coupled to the electrical conductor elements (e.g., power cable 110) within the connector 100.

Consistent with implementations described herein, a test point cap 235 may sealingly engage portion test point terminal 230 and outer shield 130. In one implementation, test point cap 235 may be formed of a semi-conductive material, such as EPDM. When test point terminal 230 is not being accessed, test point cap 235 may be mounted on test point assembly 225. Because test point cap 235 is formed of a conductive or semiconductive material, test point cap 235 may ground the test point when in position. Test point cap 235 may include an aperture 240 for facilitating removal of test point cap 235, e.g., using a hooked lineman's tool.

Figure 4A:
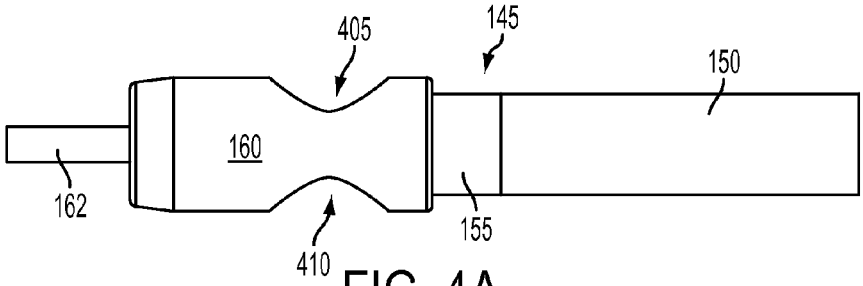
FIG. 4A is a side view of the conductor spade assembly of FIG. 1.
Figure 4B:
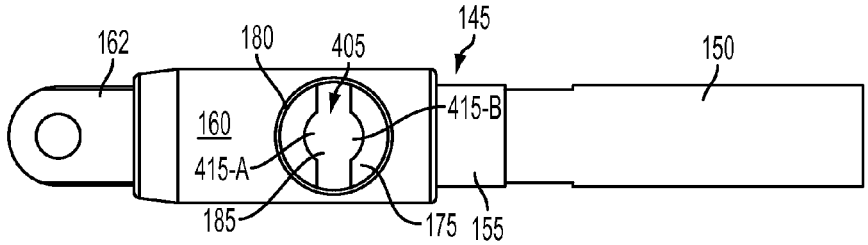
FIG. 4B is a top view of the conductor spade assembly of FIG. 1.
Figure 4C:
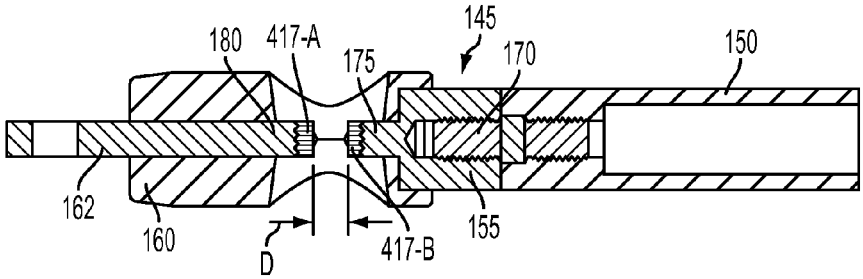
FIGS. 4C-4E are schematic cross-sectional diagrams of exemplary implementations of the conductor spade assembly of FIG. 1.

FIGS. 4A-4C are side, top, and cross-sectional views respectively, of conductor spade assembly 145 according to one exemplary implementation. As shown, body portion 160 of conductor spade assembly 145 may include a substantially cylindrical form having apertures 405 and 410 provided therein for allowing viewing of open break 185 via visible open port 120 in connector 100. As described above, spade portion 162 may extend from body portion 160 and may be separated from rearward conductor portion 155 by break 185.

In one implementation, as shown in FIGS. 4B and 4C, rearward end 180 of spade portion 162 and forward end 175 of rearward conductor portion 155 may be separated by a distance D and may include semicircular cutouts 415-A and 415-B therein configured to receive conductive core portion 210 of visible open conductor plug 200. In an exemplary embodiment, distance D may be approximately 0.600 inches. It should be understood that D may be any suitable distance. In one implementation, as shown in FIGS. 1 and 4B, semicircular cutouts 415 may include internal threads 417-A and 417-B configured to engage corresponding external threads (e.g., threads 515 in FIG. 5B) in conductive core portion 210.

Figure 4D:
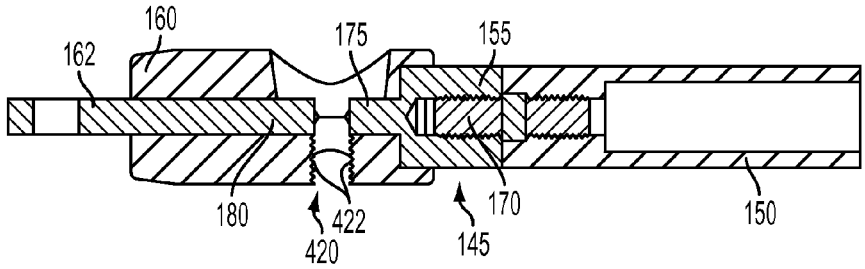

FIG. 4D is a cross-sectional illustration of another exemplary implementation of conductor spade assembly 145. As shown in FIG. 4D, body portion 160 of conductor spade assembly 145 may include a plug receiving portion 420 having internal threads 422 thereon. In this implementation, rearward end 180 of spade portion 162 and forward end 175 of rearward conductor portion 155 may be separated by a distance D and may include semicircular cutouts 415; However, cutouts 415 may not include the interior threads of the embodiment of FIG. 4C. Rather, cutouts 415 may be configured to engage a smooth lower surface of conductive core portion 210 (not shown in FIG. 1). In another exemplary implementation, plug receiving portion 420 may be formed as an insert into body portion 160, rather than being integral with body portion 160. In such an implementation, body portion 160 and plug receiving portion 420 may be suitably shaped to resist rotational movement therebetween upon insertion of visible open insulating plug 200.

Figure 4E:
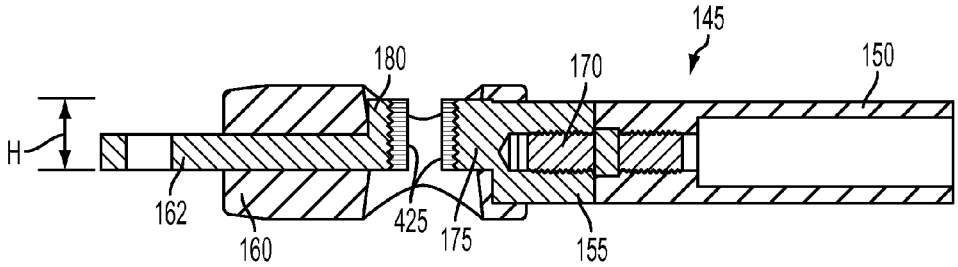

FIG. 4E is a cross-sectional illustration of another exemplary implementation of conductor spade assembly 145. As shown in FIG. 4E, rearward end 180 of spade portion 162 and forward end 175 of rearward conductor portion 155 may each have a thickness H configured to raise break 185 within aperture 405, thereby increasing the visibility of break 185 upon removal of visible open conductor plug 200. In an exemplary embodiment, thickness H may be approximately 0.5 inches to 1.0 inches. Similar to the embodiment of FIG. 4B, opposing surfaces of spade portion 162 and rearward conductor portion 155 may include semicircular cutouts 425 therein configured to receive conductive core portion 210 of visible open conductor plug 200. In one implementation, as shown in FIG. 4E, semicircular cutouts 425 may include internal threads configured to engage corresponding external threads in conductive core portion 210.

Figure 5B:
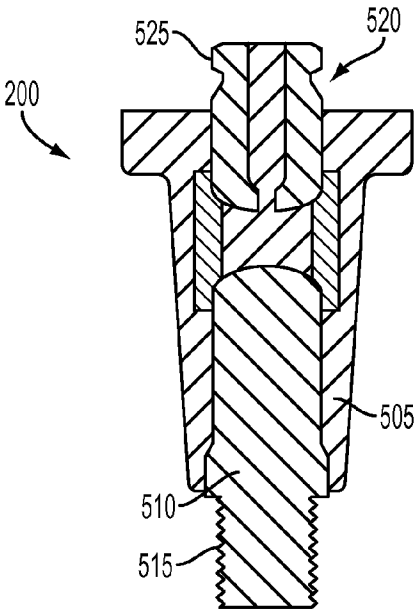
FIG. 5B is a schematic cross-sectional diagram of the visible open conductor plug of FIG. 5A.
Figure 5A:
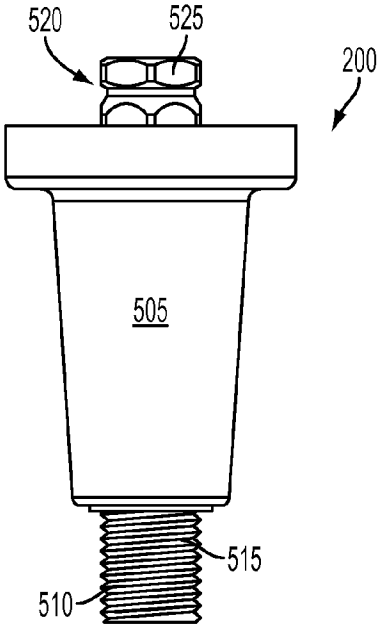
FIG. 5A is a side view of the visible open conductor plug of FIG. 1.

FIGS. 5A and 5B are side and cross-section views of a visible open conductor plug 200 consistent with implementations described herein. As shown, visible open conductor plug 200 may include an insulative body portion 505 configured in a substantially conical shape for reception in bore 190 of visible open port 122. Visible open conductor plug 200 may include a conductive core portion 510 embedded within body portion 505 and extending outwardly from body portion 505. Body portion 505 may include rubber, plastic, or some other non-conductive material. As described above, connector 100 and conductor spade assembly 145 may be configured to receive conductive core portion 510 to electrically close break 185 formed between rearward end 180 of spade portion 162 and forward end 175 of rearward conductor portion 155.

As illustrated in FIGS. 5A and 5B, an outer surface of conductive core portion 510 that extends from body portion 505 may be configured to include external threads 515 for engaging corresponding internal threads in conductor spade assembly 145, as described above in relation to FIGS. 1 and 4A-4E. Visible open conductor plug 200 may further include an assembly facilitating element 520 embedded within and extending outwardly from body portion 505. As illustrated in FIG. 5B, assembly facilitating element 520 may extend from a surface of visible open conductor plug 200 opposite from conductive core portion 510.

Further, assembly facilitating element 520 may include a tool engagement surface 525 thereon for receiving a suitable tool. Exemplary tool engagement surfaces 525 may include slots, grooves, ribs, knurls, or a hexagonal or octagonal configuration. Application of force by a suitable tool on tool engagement surface 525 may cause visible open conductor plug 200 to rotate within bore 190 relative to conductor spade assembly 145. In some implementations, visible open conductor plug may be inserted by hand and may not require tool tightening. External threads 515 may engage corresponding internal threads of conductor spade assembly 145 (e.g., threads 417-A and 417-B) during the rotation, causing the visible open conductor plug 200 to become seated within connector 100.

In addition to a visible open conductor plug (e.g., plug 200), other devices may be used in accordance with the embodiments described herein. For example, additional accessories may be modified to include a conductive core portion similar to conductive core portion 510 described above. Exemplary accessories may include a voltage sensor assembly, a surge arrester, a tap plug (e.g., a 600 Amp tap plug), etc.

Figure 6A:
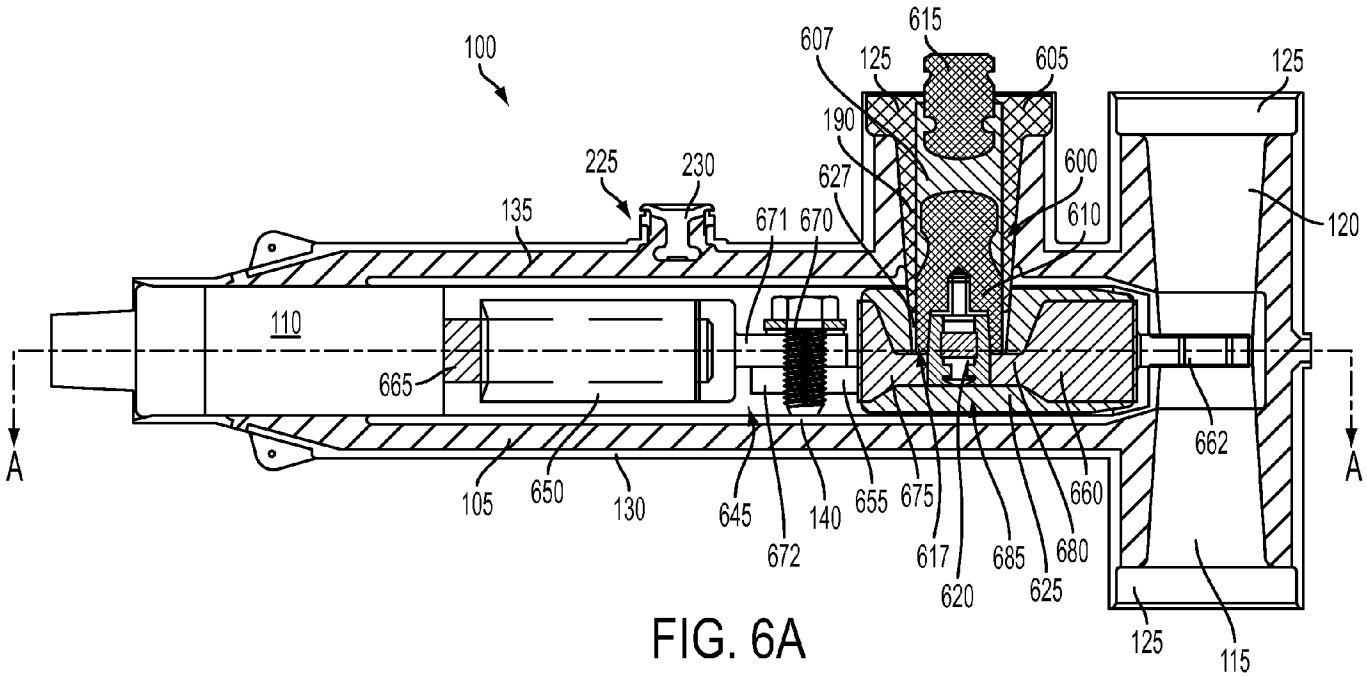
FIG. 6A is a schematic cross-sectional diagram illustrating an electrical connector consistent with implementations described herein.

FIG. 6A is a schematic cross-sectional diagram illustrating an electrical connector consistent with implementations described herein. More specifically, FIG. 6A illustrates electrical connector 100 having a conductive plug 600 and spade conductor assembly 645 and that are different from conductive plug 600 and spade conductor assembly 145 of FIGS. 1, 4A-4E, and 5A-5B. The same reference numbers in FIGS. 1-6B may identify the same or similar elements.

As illustrated in FIG. 6A, spade conductor assembly 645 may include a crimp connector portion 650, a rearward conductor portion 655, a body portion 660, and a spade portion 662. Similar to crimp connector portion 150 described above, crimp connector portion 650 may include a substantially cylindrical assembly configured to receive a center conductor 165 of power cable 110 therein.

Crimp connector portion 650 may be securely fastened to rearward conductor portion 655, such as via a stud or bolt 670 threaded into spade ends 671/672 that extend from each of crimp connector portion 650 and rearward conductor portion 655, respectively. As illustrated, upon insertion of cable 110, crimp connector portion 650 may be crimped onto power cable 110 prior to insertion into conductor receiving end 105 of connector 100.

Body portion 660 may be configured to maintain a forward end 675 of rearward conductor portion 655 and a rearward end 680 of spade portion 662 in a spaced relationship relative to each other for providing an open break 685 in the conductor. Consistent with implementations described herein, open break 685 may be visible by a user or installer by looking into visible open port 122. Visually identifying an open break in the conductor enables the installer to ensure that the connector is de-energized prior to interacting with connector 100. In one exemplary implementation, body portion 660 may be formed of an insulative material such as EPDM, or any suitably insulative material. Rearward conductor portion 655 and spade portion 662 may be formed of a suitably conductive material, such as copper, or aluminum, or a conductive alloy.

As shown in FIG. 6A, visible open conductor plug 600 may include an insulating body portion 605, an intermediate insulating portion 607, a conductive core portion 610 secured within a lower portion of insulating body portion 605 and intermediate insulating portion 607, and an assembly facilitating element 615 secured within an upper portion of insulating body portion 605 and intermediate insulating portion 607. Prior to re-energizing power cable elbow connector 100, visible open conductor plug 600 may be inserted into bore 190. In one exemplary implementation, visible open conductor plug 600 may be secured to connector 100 via a friction engagement, as described in additional detail below. In one embodiment, bore 190 of connector 100 may include a substantially conical configuration, tapering from a first diameter at an outer end of bore 190, to a second diameter smaller than the first diameter at an inner end of bore 190. An outer surface of body portion 605 may include a corresponding conical configuration and may be formed of an insulating material, such as insulative rubber or epoxy.

Figure 6B:
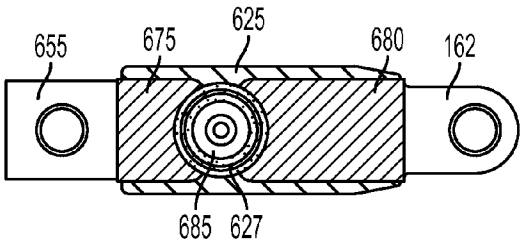
FIG. 6B is a schematic cross-sectional diagram of a top view of the conductor spade assembly of FIG. 6A.

Consistent with the embodiment of FIGS. 6A and 6B, conductive core portion 610 may include a substantially tubular projection 617 extending from a lower portion of insulating body portion 605. As will be described in additional detail below, tubular projection 617 may be configured to engage conductive portions 675 and 680 of body portion 660, effectively spanning the break between conductive portions 675 and 680 and allowing current to flow thereacross. In this manner, break 185 may be "closed" upon insertion of insulating plug 600 into bore 190.

FIG. 6B is a cross-sectional top view of body portion 660 taken along the line A-A in FIG. 6A. In contrast to body portion 160 described above, body portion 660 may include a centering pin 620 and an outer insulative portion 625 formed over and between conductive portions 675 and 680. As shown in FIG. 6B, insulative portion 625 may include substantially circular groove 627 formed thereon. Circular groove 627 may expose underlying portions of conductive portions 675 and 680. Following insertion of conductive plug 600 into bore 190, tubular projection 617 and, optionally, a portion of insulating body portion 605 may be received within circular groove 627, allowing conductive core portion 610 of conductive plug 600 to close the electrical gap between conductive portions 675 and 680.

As described briefly above, a friction engagement between conductive plug 600 and body portion 660 may be enabled by sizing a lower portion of insulating body portion 605 slightly larger than circular groove 627. In an additional implementation, a substantially cylindrical cavity within a lower portion of conductive core portion 610 may receive centering pin 620 therein. To further assist in the friction engagement between conductive plug 600 and body portion 660, a diameter of the cylindrical cavity within a lower portion of conductive core portion 610 may be sized slightly smaller than a diameter of centering pin 620.

Figure 7A:
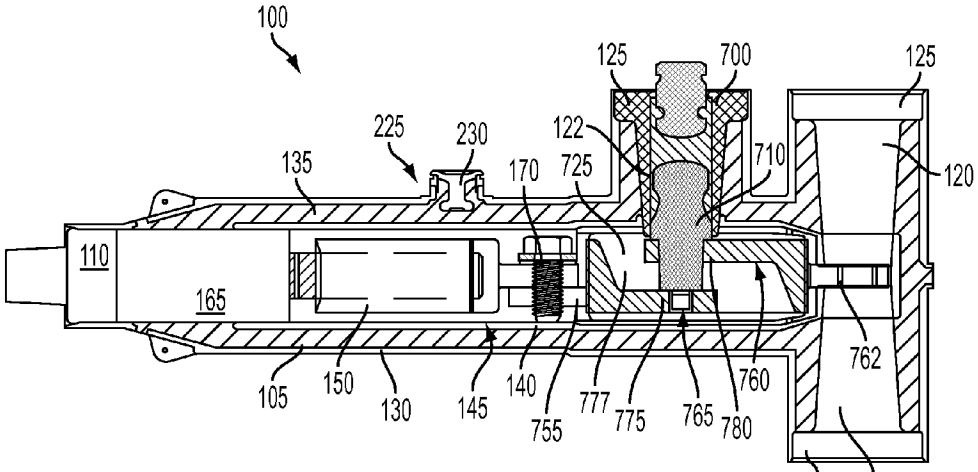
FIGS. 7A and 7B are schematic cross-sectional diagrams illustrating an electrical connector consistent with implementations described herein in conductive and non-conductive modes.
Figure 7B:
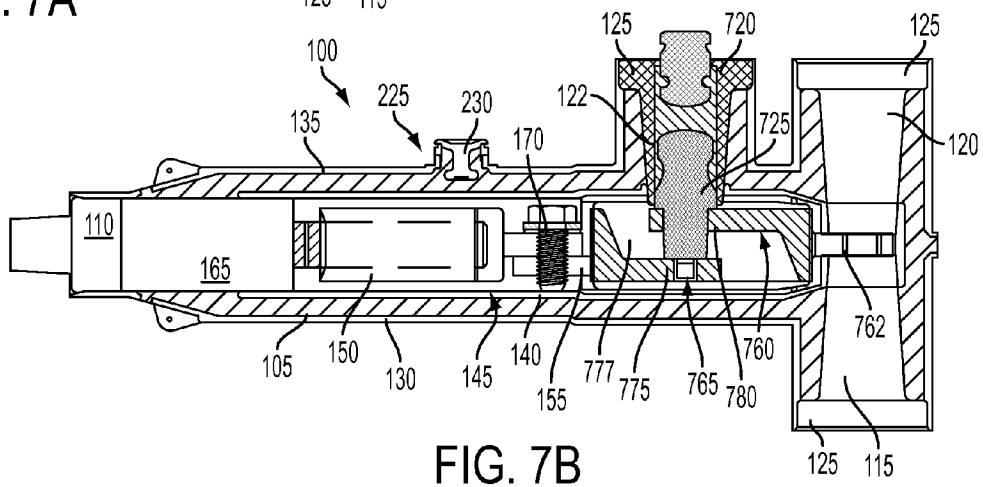

FIGS. 7A and 7B are schematic cross-sectional diagrams illustrating an electrical connector consistent with another implementation described herein. More specifically, FIG. 7A illustrates electrical connector 100 having an insulating plug 700 with an insulative core portion 710 in place of conductive core portion 210 of FIG. 1. By receiving insulating plug 700 into bore 190, it may be ensured that electrical connector 100 is in a non-conducting state, and that current is not passing between a forward end 775 of rearward conductor portion 755 and a rearward end 780 of spade portion 762 of body portion 760.

When in a non-conducting state (e.g., with insulating plug 700 positioned in bore 190), it may be possible to test electrical power cable 110 while maintaining the remainder of electrical connector 100 in a grounded state. For example, a load (e.g., a transformer, etc.) may be connected to connector 100 via T end 115 and a ground may be connected to connector 100 via T end 120. In this case, the presence of insulating plug 700 enables in bore 190 enables the power cable 110 to be tested without affecting the other portions of connector 100.

When connectivity is desired, insulating plug 700 may be removed and replaced with conducting plug 720 (illustrated in FIG. 7B). Similar to conducting plug 200 described above, conducting plug 720 may include a conductive core portion 725 projecting from a lower end of conducting plug 720. The extending portion of conductive core portion 725 may be received into a central opening 765 in body portion 760. For insulating plug 700, an extending portion of insulative core portion 710 may be received in central opening, thereby ensuring that current does not pass between forward end 775 of rearward conductor portion 755 and a rearward end 780 of spade portion 762.

In the embodiment of FIGS. 7A and 7B, body portion 760 may be similar to body portion 660 of FIGS. 6A and 6B and may include an outer insulative portion 725 formed over and between conductive portions 775 and 780 with central opening 765 formed therein that exposes portions 775 and 780. As shown, body portion 760 may include an insulative portion 777 interposed between conductive portions 775 and 780. When receiving insulating plug 700 into bore 190, insulative core portion 710 may be received into central opening 765, such that a portion of insulative core portion 710 extending from conducting plug 720 may contact exposed portions 775/780, thereby placing connector 100 into an insulative state.

Alternatively, when conducting plug 720 into bore 190, conductive core portion 725 may be received into central opening 765, such that the portion of conductive core portion 725 extending from conducting plug 720 may contact exposed portions 775/780, thereby placing connector 100 into a conducting state.

In one implementation, relative diameters of insulative core portion 710 in insulating plug 700 and conductive core portion 725 in conductive plug, and central opening 765 may be sized to provide a friction engagement between plugs 700/720 and connector 100. Alternatively, central opening 765 and plugs 700/720 may be provided with correspondingly threaded portions, such as in the embodiments of FIGS. 1-5B. In still other implementations, other securing mechanisms may be used to secure plugs 700/720 within bore 190, such as clamps, straps, clips, etc.

Figure 8:
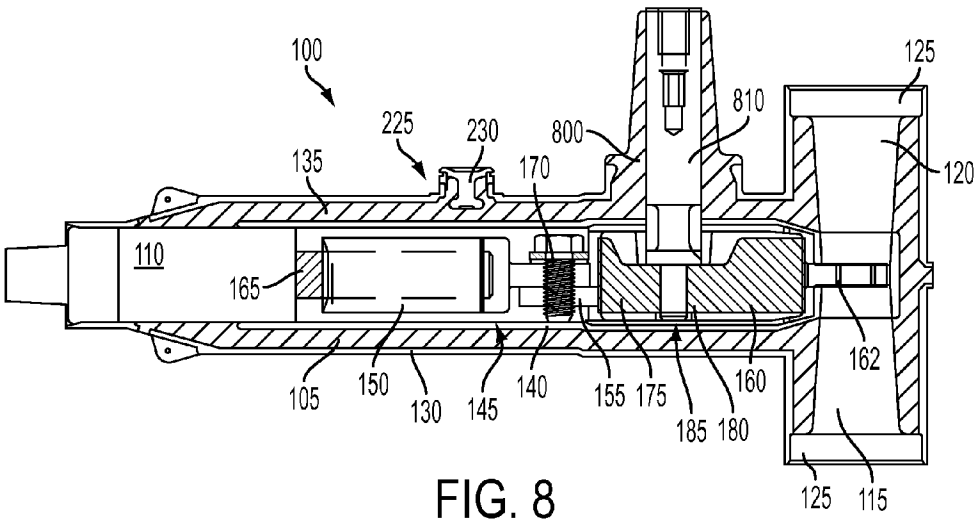
FIG. 8 is a schematic cross-sectional diagram illustrating an electrical connector consistent with another implementation described herein.

FIG. 8 is a schematic cross-sectional diagram illustrating an electrical connector consistent with another implementation described herein. More specifically, FIG. 8 illustrates electrical connector 100 having a bushing interface 800 in place of bore 190 of FIGS. 1-3 and 6A-7B. As shown, bushing interface 800 may correspond to a conventional deadbreak or loadbreak bushing insert and may include a substantially cylindrical configuration having a device receiving cavity 810 extending along a length of bushing interface 800 for receiving a conductor for a connected device, such as an elbow or other switchgear component. Similar to the embodiment of FIGS. 1-4E, body portion 160 may include an open break 185 between forward end 175 of rearward conductor portion 155 and rearward end 180 of spade portion 162. Consistent with implementations described herein, open break 185 may be visible by a user or installer by looking into bushing cavity 810.

When it is desired to restore conductivity to connector 100, a suitable loadbreak or deadbreak device (not shown), such as a 600 Amp elbow, a surge arrestor, etc., may be installed within bushing interface 800 in a known manner. The leading end of the installed device may include a conductive portion that contacts forward end 175 of rearward conductor portion 155 and rearward end 180 of spade portion 162, thereby enabling current transmission across connector 100.

Figure 9:
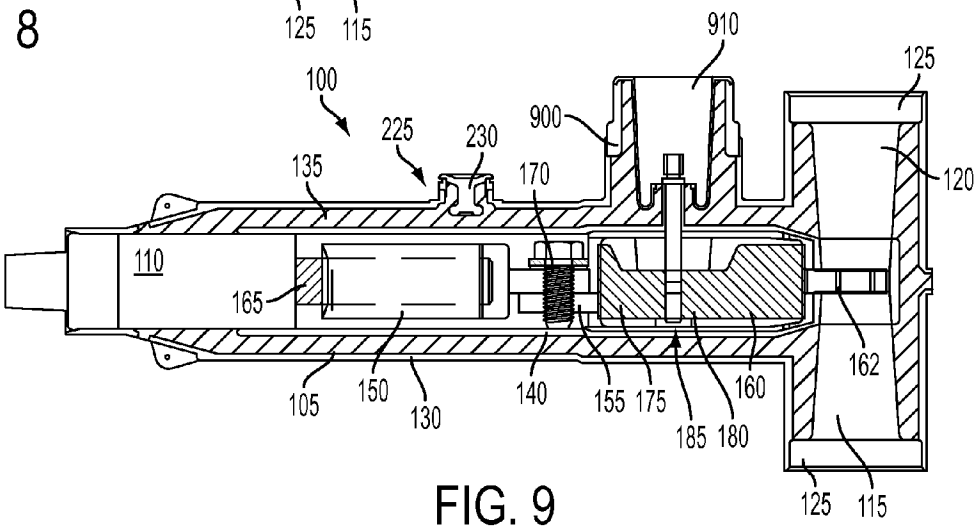
FIG. 9 is a schematic cross-sectional diagram illustrating an electrical connector consistent with still another implementation described herein.

FIG. 9 is a schematic cross-sectional diagram illustrating an electrical connector consistent with still another implementation described herein. More specifically, FIG. 9 illustrates electrical connector 100 having a bushing well interface 900 in place of bore 190 of FIGS. 1-3 and 6A-7B and bushing interface 800 on FIG. 8. As shown, bushing well interface 900 may correspond to a conventional deadbreak or loadbreak bushing interface and may include a substantially cylindrical configuration having an insert receiving cavity 910 formed therein.

Similar to busing interface 800 described above, body portion 160 may include an open break 185 between forward end 175 of rearward conductor portion 155 and rearward end 180 of spade portion 162. Consistent with implementations described herein, open break 185 may be visible by a user or installer by looking into insert receiving cavity 910.

When it is desired to restore conductivity to connector 100, a suitable loadbreak or deadbreak device (not shown), such as a 600 Amp elbow, a surge arrestor, a feed-thru insert, etc., may be installed within bushing well interface 900 in a known manner.

By providing an effective and safe mechanism for monitoring an open break in an electrical connector without requirement removal of switchgear components, various personnel may be more easily able to safely identify and confirm a de-energized condition in a switchgear assembly. More specifically, consistent with aspects described herein, personnel may be able to view a physical open break, and not merely an indicator of an open status, thereby more fully ensuring the personnel that the equipment is, in fact, de-energized. Furthermore, by providing the visible open on an elbow connector connected to the switchgear, existing or legacy switchgear may be easily retrofitted and the entire system may maintain a ground connection throughout operation.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other high voltage switchgear equipment, such as any 15 kV, 25 kV, or 35 kV equipment.

For example, various features have been mainly described above with respect to elbow power connectors. In other implementations, other medium/high voltage power components may be configured to include the visible open port configuration described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a connector having a conductor receiving end, a first T end, and a visible open port;

a conductor spade assembly extending axially within the connector from the conductor receiving end to the first T end; and a conductive plug for insertion into the visible open port, wherein at least a portion of the conductor spade assembly is visible through the visible open port prior to insertion of the conductive plug or following removal of the conductive plug, wherein the portion of the conductor spade assembly visible through the visible open port includes a rear conductor having a first contact portion and a front conductor having a second contact portion separated by an open break therebetween, and wherein a portion of the conductive plug is received in the open break between the first contact portion and the second contact portion to allow current to flow from the second contact portion to the first contact portion upon insertion of the conductive plug into the visible open port, wherein the conductor spade assembly further comprises a body portion having an aperture formed therein, wherein the body portion is configured to support the first contact portion and the second contact portion, wherein the aperture in the body portion is aligned with the visible open port, and wherein the open break between the first contact portion and the second contact portion is provided in the aperture, such that the open break is visible through the visible open port.

2. The electrical connector assembly of claim 1, wherein the body portion of the conductor spade assembly, comprises an insulative material.

3. The electrical connector assembly of claim 1, wherein the conductor spade assembly further comprises a cable receiving portion connected to the second contact portion.

4. The electrical connector assembly of claim 3, wherein the cable receiving portion of the conductor spade assembly comprises a crimp connector configured to receive and securely attach to an electrical cable.

5. The electrical connector assembly of claim 1, wherein the first contact portion and the second contact portion comprise copper or aluminum.

6. The electrical connector assembly of claim 1, wherein the conductor spade assembly comprises a spade portion that includes the first contact portion on one end and a connector end distal from the first contact portion, wherein the connector end is configured to attach to an electrical device via the first connector end.

7. The electrical connector assembly of claim 1, wherein the visible open port projects from the conductor receiving end and includes a bore therein, wherein the bore is aligned with the portion of the conductor spade assembly that includes the open break.

8. The electrical connector assembly of claim 7, wherein the conductive plug is received in the bore.

9. The electrical connector assembly of claim 8, wherein the conductive plug further comprises:

a body portion; and a core conductor portion extending from the body portion, wherein the body portion comprises an insulative material and the core conductor portion comprises a conductive material, wherein a portion of the core conductor portion is received in the open break between the first contact portion and the second contact portion to allow current to flow from the second contact portion to the first contact portion.

10. The electrical connector assembly of claim 8, wherein the conductor spade assembly includes internal threads, and wherein the core conductor portion of the conductive plug includes external threads for securing the conductive plug to the contact assembly via the internal threads in the contact assembly.

11. The electrical connector assembly of claim 10, wherein the body portion of the conductor spade assembly includes the internal threads.

12. The electrical connector assembly of claim 10, wherein the first contact portion and the second contact portion of the conductor spade assembly include the internal threads.

13. The electrical connector assembly of claim 10, further comprising:

an insert included in the aperture in the body portion of the conductor spade assembly, wherein the insert includes the internal threads.

14. The electrical connector assembly of claim 1, wherein the first contact portion and the second contact portion have a thickness ranging from about 0.5 inches to about 1.0 inches to increase a visibility of the open break via the visible open port.

15. A power cable elbow connector assembly, comprising:

a connector body having a conductor receiving opening, a first T end projecting substantially perpendicularly from the connector, and a visible open port projecting substantially perpendicularly from the connector between the first T end and the conductor receiving opening; and a conductor spade assembly extending axially within the connector body and including a rear conductor having a first contact and a front conductor having a second contact separated by an open break therebetween, wherein the open break is visible through the visible open port following removal of a device from the visible open port or prior to insertion of the device in the visible open port, thereby enabling visual confirmation of a de-energized condition of the power cable elbow connector assembly, wherein the device comprises a conductive plug received in the open break for allowing energizing of the power cable elbow connector assembly, and wherein the first contact and the second contact together comprise internal threads for receiving external threads on a conductive portion of the device.

16. A system, comprising:

an electrical connector comprising:

a conductor receiving end for receiving a cable, wherein the conductor receiving end includes an axial bore therethrough and an and opening at one end thereof for receiving the cable;

a first T end projecting substantially perpendicularly from the conductor receiving end at an end distal from the opening, and a viewing port projecting substantially perpendicularly from the conductor receiving end between the opening and the first T end;

a conductor spade assembly extending axially within the axial bore from the opening to the first T end, wherein the conductor spade assembly comprises:

a body portion having an aperture therein configured to align with the viewing port upon insertion of the conductor spade assembly into the axial bore;

a spade portion extending from the body portion toward the first T end, wherein the spade portion includes a first contact portion extending into the aperture;

a rearward contact portion extending from the body portion toward the conductor receiving end, wherein the rearward contact portion includes a second contact portion extending into the aperture, wherein the first contact portion and the second contact portion are separated by an open break visible through the viewing port;

a conductive plug for insertion into the viewing port, wherein the conductive plug includes a conductor portion that extends into the open break between the first contact portion and the second contact portion and allows current to flow from the rearward contact portion to the spade portion.

* * * * *